US006691461B1

(12) United States Patent
Gitkin

(10) Patent No.: US 6,691,461 B1
(45) **Date of Patent: *Feb. 17, 2004**

(54) SHUTTER MOUNTING ASSEMBLY INCLUDING A SUPPORT BAR AND WIDTH-ADJUSTING STRIPS

(76) Inventor: Alan J. Gitkin, 75-15 Pelican Bay Blvd., Suite 16A, Naples, FL (US) 34108

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/374,706

(22) Filed: Aug. 13, 1999

Related U.S. Application Data

(63) Continuation-in-part of application No. 09/133,206, filed on Aug. 13, 1998, now abandoned.

(51) Int. Cl.[7] ..... E06B 1/10; E06B 1/20

(52) U.S. Cl. ..... 49/74.1; 49/505; 52/217

(58) Field of Search ..... 49/482.1, 475.1, 49/74.1, 505; 52/217, 204.56, 202, 126.1, 212

(56) References Cited

U.S. PATENT DOCUMENTS

| | | | | | |
|---|---|---|---|---|---|
| 2,385,612 | A | * | 9/1945 | Coutlee | 242/166 |
| 3,250,040 | A | * | 5/1966 | Squires | 49/482.1 |
| 3,698,146 | A | * | 10/1972 | Brents | 52/214 |
| 4,271,566 | A | * | 6/1981 | Perina | 24/442 |
| 4,336,879 | A | * | 6/1982 | Carr | 206/323 |
| 4,610,291 | A | * | 9/1986 | Carroll | 160/117 |
| 4,858,405 | A | * | 8/1989 | Christie | 52/208 |
| 4,888,924 | A | * | 12/1989 | Grisham et al. | 52/217 |
| 5,010,691 | A | * | 4/1991 | Takahashi | 49/482.1 |
| 5,054,250 | A | * | 10/1991 | Foss | 52/126.1 |
| 5,419,085 | A | * | 5/1995 | Imbur | 49/398 |
| 5,561,955 | A | * | 10/1996 | Frobosilo et al. | 52/217 |
| 5,640,813 | A | * | 6/1997 | Glazik et al. | 52/126.1 |
| 5,778,958 | A | * | 7/1998 | Stebner | 160/210 |
| 5,845,439 | A | * | 12/1998 | Hendley | 52/204.1 |
| 5,848,505 | A | * | 12/1998 | Taylor | 52/202 |
| 6,018,916 | A | * | 2/2000 | Henry | 52/126.1 |
| 6,125,581 | A | * | 10/2000 | Grossman | 49/74.1 |
| 6,572,945 | B2 | * | 6/2003 | Bries et al. | 428/40.1 |

FOREIGN PATENT DOCUMENTS

| | | | | |
|---|---|---|---|---|
| FR | 2546567 | * | 11/1984 | 49/475.1 |

* cited by examiner

*Primary Examiner*—Gregory J. Strimbu
(74) *Attorney, Agent, or Firm*—Leonard Cooper

(57) ABSTRACT

A plurality of strips are releasably interconnected to a support bar as an assembly for mounting a shutter within a window frame. Male and female connectors such as tongue and groove or pin and socket connectors interconnect the strips to one another and to the support bar. The strips, located between the bar and the window frame, may be manually added or removed from the support bar by transverse motion individually with a low force to adjust the width of the shutter mounting assembly to fit the shutter to window frames of various widths without need for tools.

11 Claims, 3 Drawing Sheets

SHUTTER MOUNTING ASSEMBLY INCLUDING A SUPPORT BAR AND WIDTH-ADJUSTING STRIPS

This application is a continuation in part of Ser. No. 09/133,206, filed Aug. 13, 1998, now abandoned.

BACKGROUND OF THE INVENTION

The present invention relates in general to shutters and shutter frames and in particular to a shutter frame which includes a rigid support bar and a plurality of easily separable strips or slats detachably connectable to the support bar and to each other.

Description of Prior Developments

Pre-assembled shutter sets are known to include shutter panels, hardware and hanging strips which attach to a window frame. Such shutter sets are sold in stock sizes primarily in retail stores. Consumers typically purchase a shutter set in a size most closely resembling the finished size of their window frame.

Since the finished dimensions of window openings almost always vary, the consumer, during shutter installation, must trim various elements of the shutter set in order to properly fit the set into the frame. Standard shutter set sizes can be as long as 74 inches in height. The various elements that may have to be trimmed are the sides of the shutter panels and/or the hanging strips that hold the shutters into the window frame. Trimming is most often accomplished by using some type of electric powered table saw or circular saw that has a greater facility for creating a straight line than a hand saw.

A problem arises when the consumer does not possess the expertise to properly trim the various elements of the shutter set. Unless trimmed in a precisely straight and square manner, the shutter set will be out of square with the window frame and may look crooked upon installation. Another problem arises with poor trimming techniques when the hanging strips have an uneven and unsightly look and will not fit flush with the window frame, thereby allowing unwanted light into the room. A further problem arises if the consumer excessively trims any of the elements. In this event, the entire shutter set will look too small on the window.

Another problem arises if the consumer does not have the proper power equipment to properly trim the shutter sets or does not have the working space to lay out and trim the shutters. In this case, they may have to hire a skilled worker, at an unwanted cost, to do the trimming. Moreover, trimming is somewhat time consuming.

A further problem arises if the consumer does not have or want to take the proper amount of time to complete the job properly.

SUMMARY OF THE INVENTION

The present invention has been developed to fulfill the needs noted above and therefore has as an object the provision of a shutter frame which is easily adjusted to fit windows of varying sizes.

Another object of the invention is to provide a shutter mounting system whereby the consumer can speedily trim the shutter set using no tools whatsoever.

Another object of the invention is the provision of a rigid support bar for a shutter frame which is attachable to one or more width-adjusting strips for adjusting the width of the frame to fit windows of varying widths.

Another object of the invention is the provision of an adjustable width shutter frame assembly that requires no tools or cutting to size the shutter frame to the correct width within a window frame.

Another object of the invention is to provide a shutter mounting system wherein the trimming of a mounting frame is uniform and square in every case, thereby creating a shutter set that looks professionally and properly installed.

Another object of the invention is the provision of a peel-away, width-adjusting strip for use with a support bar for supporting a shutter in a window frame.

A further object of the invention is the provision of a support bar and a plurality of loose or interconnected width-adjusting strips packaged together in a kit for forming an adjustable-width shutter frame.

Still another object of the invention is the provision of a rigid support bar and a plurality of width adjusting strips wherein the strips are interconnectable with one another and with the support bar in a purely manually constructed assembly.

Yet another object of the invention is the provision of such a manually assembled construction wherein the interconnection between the strips and support bar is in the form of a tongue and groove interconnection and/or a pin and socket interconnection.

Another object of the invention is the provision of an adjustable shutter frame assembly which includes a plurality of width-adjusting strips which interlock and stay in place without adhesives, can be peeled away one strip from the other, and can be reattached as may be required.

These and other objects are met in accordance with the present invention which is directed to an adjusted-width frame for mounting a shutter to a window opening. A series of interconnectable slats or strips forms an adjustable-width frame when the strips are removably connected to a support bar. The stacked or laminated strips can be provided with a tight or loose interfit between each other as well as with the support bar. The strips can be stacked or laminated one against another and the entire laminated subassembly can then be connected or assembled to a support bar.

The support bar and strips may be provided in a kit as a loose support bar and a plurality of loose strips or slats. Alternatively, the strips and support bar may be provided as a single assembly with a series of strips connected to one another and the series of strips connected to the support bar in a unitary assembly. In this latter case, the strips may be peeled from the assembly, one at a time, to adjust the width of the frame to fit a particular window opening.

The strips and support bars are preferably provided with preformed bores or holes for facilitating the insertion of mounting hardware, such as screws or other fasteners, to allow the frame assembly to be secured to a window frame. The fasteners lock the frame assembly together, i.e., clamp the strips together and against the support bar, as well as anchor the strips and support bar to the window frame.

The strips and support bar are provided with easily assembled and easily detached connections which allow the strips to be easily manually stacked together in a single subassembly and easily manually separated from one another and from the support bar. If a tongue and groove or pin and socket interconnection is provided, the strips may squeezed together to form a series of interconnected strips or peeled apart to separate the strips from one another and/or from the support bar.

The interconnections provide centering and alignment between each adjacent strip and between the strips and the support bar. Although adhesive can be used to hold the strips to one another and to the support bar, a snap fit or tight interference fit is generally preferred insofar as adhesive can tend to collect dirt, if exposed to the ambient. Of course, a loose fit can be used, although this can somewhat complicate the fastening of the frame assembly to a window frame as the strips may have to be held together manually during frame mounting.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the various figures of the drawings, like reference numerals designate like or similar parts.

DESCRIPTION OF PREFERRED EMBODIMENTS

Figure 1:
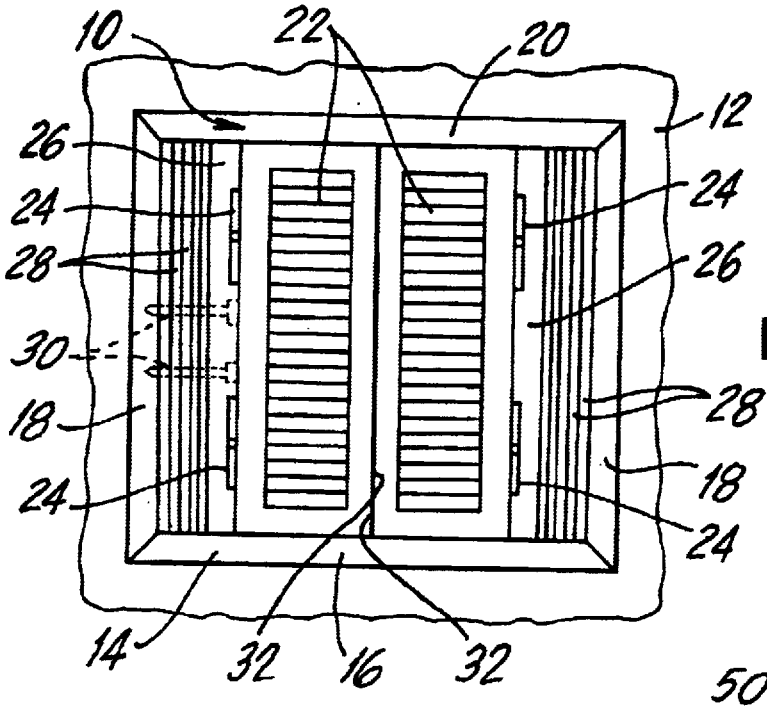
FIG. 1 is a partial schematic view of a window frame fitted with a pair of shutters mounted to the window frame with a pair of shutter mounting assemblies constructed in accordance with the invention.

The present invention will now be described in conjunction with the drawings, beginning with FIG. 1 which shows a window opening 10 formed in the wall 12 of a building. The opening 10 is typically an interior opening but may also be an exterior opening. A rectangular window frame 14 includes a sill 16, two opposed side walls 18 and a top wall 20.

A pair of shutters 22 is pivotally mounted within the window frame 14 on hinges 24. The hinges pivotably interconnect the shutters 22 with a pair of rigid support bars 26. The horizontal, lateral or transverse position of the support bars 26 and thus the corresponding position of the shutters 22 is adjusted and set with a series of detachable laminated width-adjustment strips 28.

The support bars 26 and strips 28 are clamped together and held securely against the side walls 18 of the window frame 14 with, for example, threaded fasteners such as screws 30. This provides a secure anchorage for holding and supporting the shutters 22 within the window frame 14. It can be appreciated that by inserting more of the strips 28 between the support bars 26 and side walls 18, the shutters 22 can be properly centered in wider window frames. If fewer of the strips 28 are used, the shutters can be properly aligned in narrower window frames.

Figure 2:
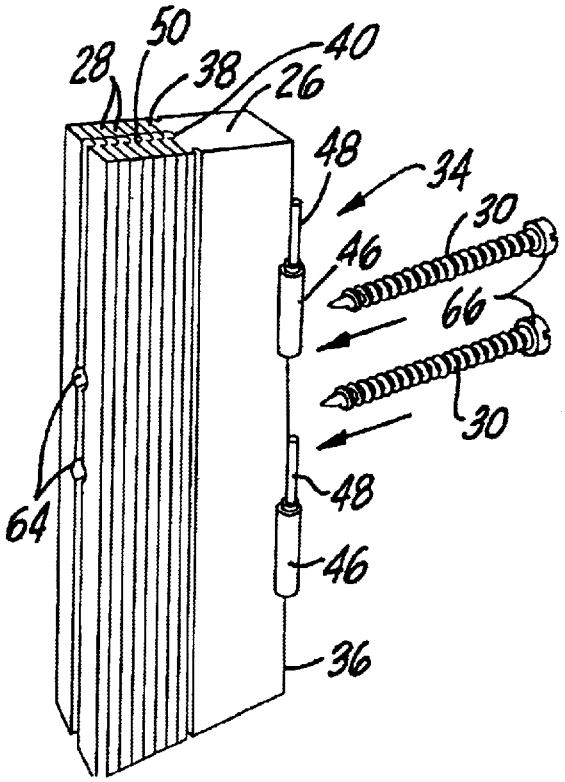
FIG. 2 is an enlarged view of one of the shutter mounting assemblies of FIG. 1.

Accordingly, strips 28 allow the adjoining edges 32 of the shutters 22 to be adjusted to closely close against one another in a centered position within window frames having various widths. Details of a shutter mounting assembly 34 of the type shown in FIG. 1 are shown in FIG. 2 wherein a series of interconnected strips 28 is detachably connected to a support bar 26 in accordance with a first embodiment of the invention. As viewed in FIGS. 1 and 2, the support bar 26 has an inner vertical face 36 facing the shutters 22 and an outer vertical face 38 facing the side walls. A longitudinal groove 40 is formed along the center of the outer vertical face 38 for interconnecting the support bar 26 with one or more strips 28.

Figure 3:
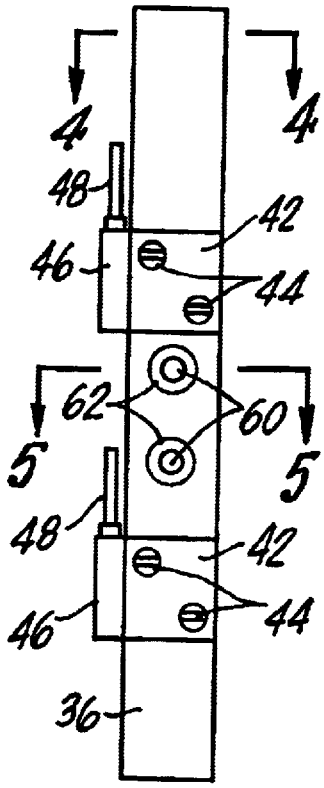
FIG. 3 is a right side view of the assembly of FIG. 2.

As seen in FIGS. 2 and 3, a pair of brackets 42 is fastened to the inner face 36 of support bar 26 with threaded fasteners 44. A hinge barrel or sleeve 46 is formed on the outer edge of each bracket 42 for receiving a pivot pin 48. A shutter hinge barrel is mountable to pivot pin 48 in a known fashion to pivotably connect the shutter 22 to a support bar 26.

In the embodiment of FIGS. 2–6 and 8, a resilient, snap-fit interconnection is provided between the individual strips 28 as well as between any one of the strips 28 and the support bar 26. The interconnection is formed by a longitudinally extending rib 50 which can extend partially, and preferably completely along the length of each strip 28. A rib 50 is formed along the inner face 52 of each strip and a channel or groove 54 is formed along the opposing outer face 56. The length of the ribs 50 and grooves 54 should be approximately equal, or the groove 54 should be at least as long as or longer than the rib 50.

Figure 4:
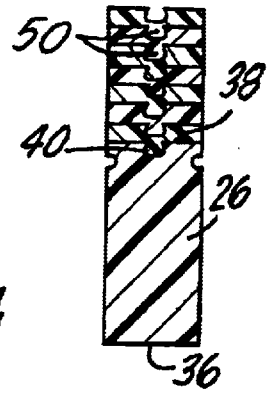
FIG. 4 is a view in section taken through line 4—4 of FIG. 3.
Figure 5:
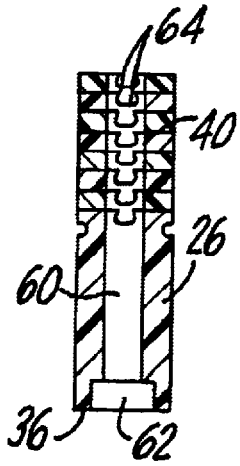
FIG. 5 is a view in section taken through line 5—5 of FIG. 3.
Figure 6:
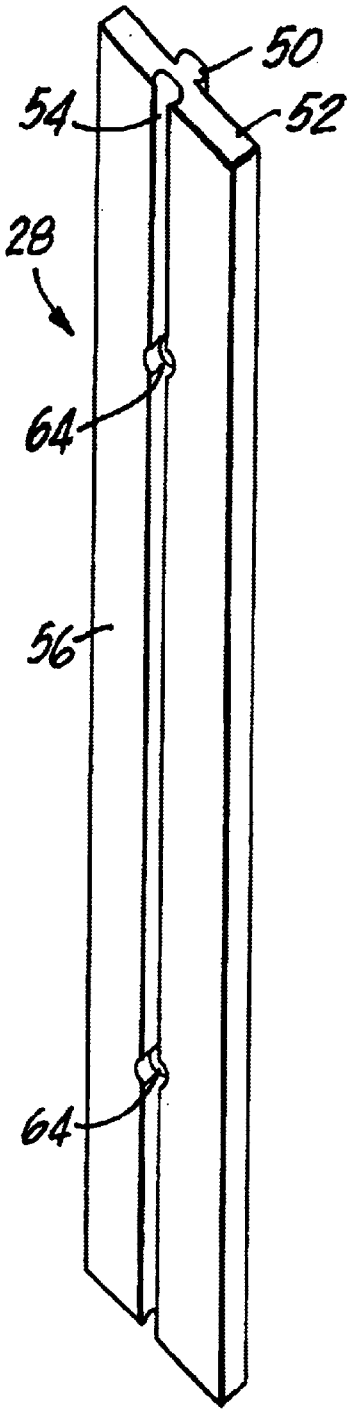
FIG. 6 is a perspective view of one of the adjustment strips of FIGS. 1–5.

As best seen in FIGS. 4, 5 and 6, the cross section of ribs 50 is somewhat bulbous or teardrop shaped. The cross sections of grooves 54 are correspondingly or complementarily shaped to receive the ribs 50 with a snap fit. The fit need not, however, be a snap fit, but may be a simple interference fit or even a loose fit, although a loose fit can complicate installation. The tongue and groove interconnection between the ribs and grooves is preferable easily made with a manual or push and easily disconnected with a manual peeling motion carried out with one's fingers. Flexibility of the strips allows for peeling one strip from a connected strip.

Although, the male and female connector elements 40, 50, 54 are illustrated as longitudinally extended, that is parallel to the length of the support bar 26, it should be understood that in alternative embodiments in accordance with the invention, a plurality of shorter connector elements (not shown) may be oriented transversely (not shown) to the length of the members and provide alignment and releasable connections between the strips 28 and between the strips and support bars.

The support or spacer bar 26 is provided with one or more through bores 60 having counterbores 62 formed in the inner face 36. The strips 28 are also provided with through bores or holes 64 which are alignable with the through bores 60 on the spacer or support bar 26. In this manner, a fastener 30 can be easily inserted through the support bar 26, through the strips 28 and threaded into the window frame 14 as shown in dashed lines in FIG. 1. The heads 66 of fasteners 30 seat themselves within counterbores 62 and clamp and fasten the support bar 26 and strips 28 to the window frame 14.

Figure 7:
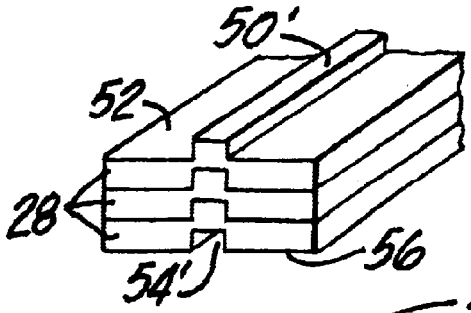
FIG. 7 is a partial perspective view of tongue and groove interconnections provided between the strips for aligning the strips in uniform configurations.
Figure 8:
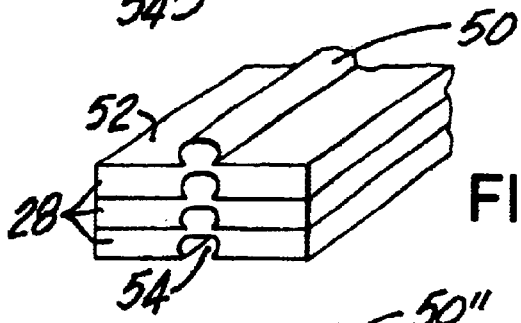
FIG. 8 is a view similar to FIG. 7 of another interconnection between the strips.
Figure 9:
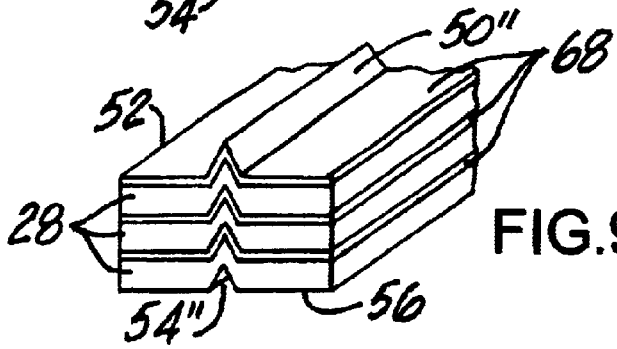
FIG. 9 is a perspective view similar to FIG. 7 of still another interconnection between strips.

When the strips are held to one another and to the spacer bar with a snap or other type of interference fit, the entire assembly of strips and spacer bars is or can be securely interconnected as an integral unit. Several other types of interconnections are shown in FIGS. 7 and 9. In FIG. 7, rectangular cross sectioned ribs 50' and grooves 54' can be dimensioned to form a snug interference fit which holds the strips together and holds the series of strips to the spacer bar as a secure integral assembly. Alternatively, the rectangular sectioned ribs and grooves can be dimensioned with a loose interfit which provides alignment between the strips and support bar but not sufficient interference force to hold the strips to each other or to the support bar.

Triangular tongue-and-groove ribs 50" and grooves 54" are provided on the strips of FIG. 9 to form a loose but accurately aligned assembly with a support bar formed with a complementarily shaped triangular groove. If desired, a layer of weak adhesive 68 may be provided between strips to hold the strips together yet allow the strips to be peeled apart from each other and from the support bar. Other tongue and groove cross sections can be used, such as semicircular, oval or polygonal sectioned tongue and grooves. The invention basically requires a male and female connector formed on each strip and either a male or female connector formed on the support bar to receive the male or female connector on the spacer bars. Preferably the spacer or support bar 26 has a female connector element.

Figure 10:
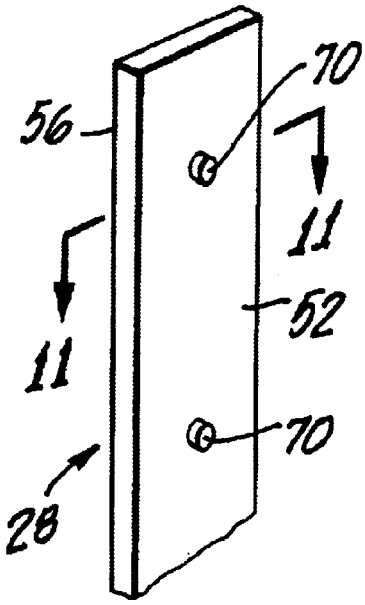
FIG. 10 is a partial perspective view of an alternative embodiment of the invention wherein the adjustment strips are held together with a pin and socket interconnection.
Figure 11:
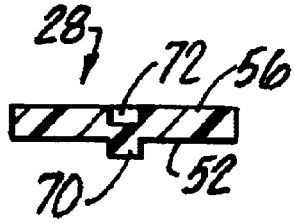
FIG. 11 is a view in section taken through line 11—11 of FIG. 10.

For example, instead of the tongue and groove type of male and female interconnection discussed above, a pin and socket interconnection can be used to practice the invention as shown in FIGS. 10–16. In FIGS. 10 and 11, at least one projection, such as a cylindrical pin 70, is formed on the front face or inner face 52 of each strip 28. A matching cylindrical socket or recess 72 is formed on the outer face 56 directly behind each pin 70. The pin 70 and socket 72 are preferably formed with a tight interference fit to hold a series of strips 28 tightly together and to hold the laminated subassembly of strips 28 tightly to a support bar 26 as a unitary assembly which does not require additional support to hold together. Of course, a loose fit between the pins and sockets solely for alignment purposes only is also possible.

Figure 13:
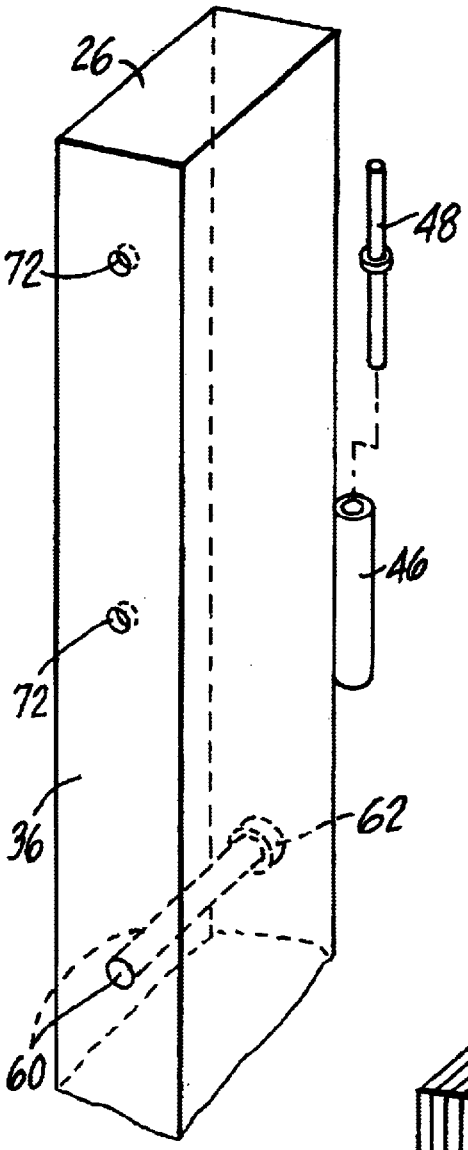
FIG. 13 is a partial perspective view of a support bar formed with a sockets or recesses for interconnection with the adjustment strips of FIGS. 10–12.
Figure 12:
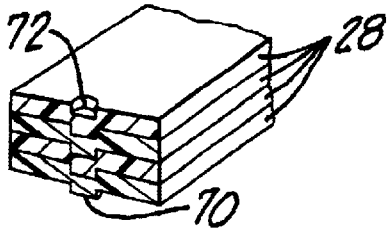
FIG. 12 is a partial perspective view, in section, of a stack of adjustment strips of the type shown in FIGS. 10 and 11.
Figure 14:
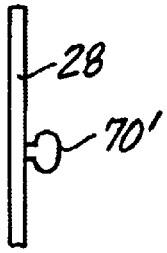
FIG. 14 is a partial side view of variations of the cylindrical pins of FIG. 10.
Figure 15:
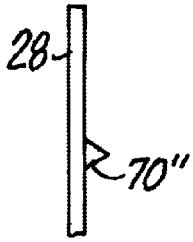
FIG. 15 is a partial side view of conical pins.

As seen in FIG. 13, a support bar 26 is formed with sockets 72 spaced apart on the inner face 36 to tightly receive the pins 70 of the strip 28 of FIGS. 10, 11 and 12.

Figure 16:
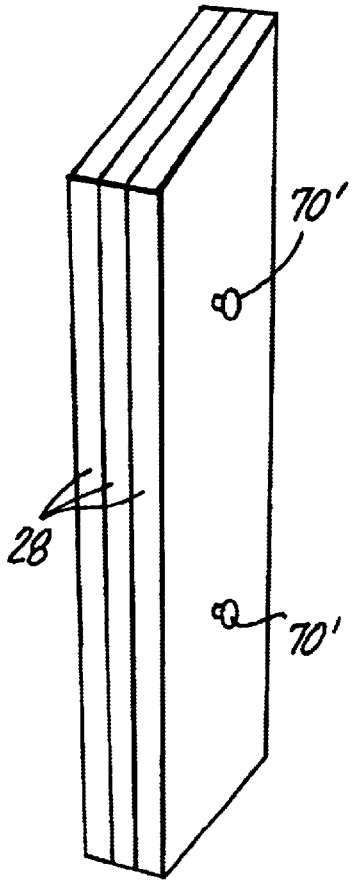
FIG. 16 is a perspective view of a stack of tapered adjustment shims for use with window frames which are not plumb or square.

If desired, the strips 28 may be tapered in width from top to bottom as shown in FIG. 16 to adapt the strips 28 and spacer bar 26 to fit within skewed or out of plumb window frames. Any of the male and female interconnections noted above may be used to hold the tapered strips in a unitary lamination. Ball shaped pins 70' are shown as an example of a male connector element. The balls fit within complementary recesses (not shown), which receive the balls with a snap fit. Conical male connectors 70" (FIG. 15) fit in complementary recesses (not shown) with a friction fit.

In any of the examples noted above, a double sided adhesive strip may be used in place of any of the tongue and groove and pin and socket interconnections. In this case, the strips 28 may be formed with flat planar surfaces 52, 56 without any projections or recesses.

Figure 17:
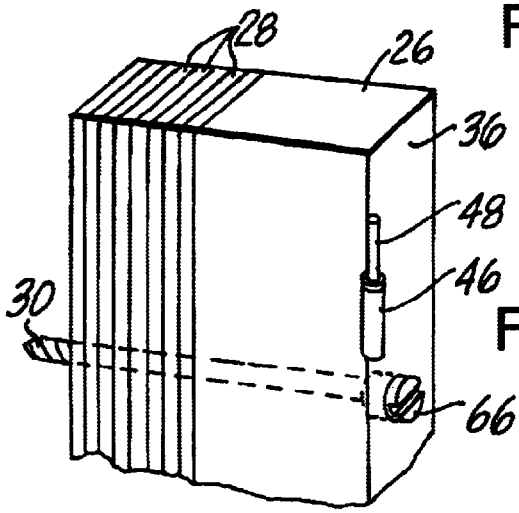
FIG. 17 is a partial perspective view of another embodiment of the invention wherein the adjustment strips are frictionally and removably held on the support with a pin or fastener.

Another embodiment of the invention is shown in FIG. 17 wherein no male and female interconnections are provided and no adhesive is used between the laminated strips and between the laminated strips and the support bar. In this example, the strips 28 are held together and to the support bar by one or more fasteners 30. The strips are held by a friction fit on the fastener or fasteners and can be easily manually pulled off or pushed onto and over the free pointed end of the fastener. In this manner, the fastener 30 is pre-mounted in the bores 60 and 64 in the support bar and strips.

The strips 28 and support bar 26 may be formed of wood, plastic or any other rigid or semi-rigid material. Plastic materials are preferred such as thermoplastics arid PVC. In the case of PVC, the thin strips are quite flexible, yet the thicker support bar is quite rigid.

It should be noted that when a tongue and groove interconnection is provided along the entire length of the strips and support bar, no light can pass through the interconnected strips or through the connection of the strips with the support bar. This is generally preferable to loosely laminated shims which can allow light to pass through cracks between adjacent shims as well as between the shims and any support bar.

In one example, eight strips 28, each one-eighth of an inch in thickness, can be provided for each support bar 26 to allow for a two inch adjustment in width of the shutters 22 within a window frame 14. It is possible to provide a shutter 22 pivotally attached to a support bar 26 along with a series of strips 28 either connected to the support bar 26 or as loose strips. The shutter 22, support bar 26 and strips 28 can be provided as a kit or provided as individually packaged items. Although a female connector has been illustrated on each support bar, a male connector can be provided instead, such as a tongue or pin. In this case, the strips 28 would be modified to interconnect with the pin, tongue or other male connector on the support bar.

There has been disclosed heretofore preferred embodiments of the invention presently contemplated. However, it is to be understood that various changes and modifications may be made thereto without departing from the spirit of the invention.

What is claimed is:

1. A shutter assembly for mounting in a window opening having a frame, comprising:

a shutter;

a plurality of elongated flexible strips arranged in a peelable stack, each said strip having a length and first and second opposed surfaces; a male connector formed on each said first surface; a female connector formed on each said second surface for repetitively engaging and disengaging said male connector on another strip in said plurality of strips, engagement of said strips holding said strips together;

a support bar having an inner surface and an outer surface; one of said female connector and said male connector on said outer surface connecting with one of said male and female connectors of said strips respectively, said inner surface being devoid of said male and female connectors of said strips, said shutter being pivotably connected to said inner surface to permit said shutter to pivot relative to said support bar and said strips.

2. The assembly of claim 1, wherein said male connectors comprise ribs and said female connectors comprise grooves.

3. The assembly of claim 2, wherein each of said ribs and said grooves extend parallel to said length of said strip.

4. The assembly of claim 1, wherein said male connectors comprise pins and said female connectors comprise sockets.

5. The assembly of claim 1, wherein each of said strips has a hole formed therethrough.

6. The assembly of claim 1, wherein said support bar has a bore formed therethrough connecting said inner surface and said outer surface.

7. The assembly of claim 1, wherein said male and female connectors are connected with one of snap, press, and interference fits between said strips.

8. A shutter mounting kit for mounting a shutter in a framed opening, comprising:

a plurality of elongated flexible strips, each said strip having a length, male connectors and female connectors on surfaces of said strips for repetitively interconnecting said strips and disconnecting said strips, said strips being arranged in a laminated, peelable stack, interconnection of said strips holding said strips together;

a support bar having an outer surface, and an inner surface, said inner surface being devoid of said male and female connectors, and one of said male connector and said female connector on said on surface for repetitively interconnecting and disconnecting any one of said strips to and from said support bar at said outer surface; said interconnectings and disconnectings being doable without tools.

9. The kit of claim 8, wherein said third one of said male connector and said female connector on said outer surface comprises one of said female connectors formed on said support bar.

10. The kit of claim 8, further comprising a fastener insertable through an opening in said support bar.

11. The kit of claim 8, wherein at least one of said strips has a tapered cross section.

* * * * *

UNITED STATES PATENT AND TRADEMARK OFFICE

CERTIFICATE OF CORRECTION

PATENT NO. : 6,691,461 B1
DATED : February 17, 2004
INVENTOR(S) : Alan J. Gitkin It is certified that error appears in the above-identified patent and that said Letters Patent is hereby corrected as shown below:

Column 8,
Line 10, change “on surface” to -- outer surface --.
Line 15, delete “third”.

Signed and Sealed this

Thirteenth Day of April, 2004

JON W. DUDAS
*Acting Director of the United States Patent and Trademark Office*